United States Patent [19]

Behling et al.

[11] Patent Number: 4,992,019

[45] Date of Patent: Feb. 12, 1991

[54] RUBBISH COLLECTION VEHICLE

[75] Inventors: Hans-Jurgen Behling, Hannover; Friedrichwilhelm Schmadeke, Neustadt, both of Fed. Rep. of Germany

[73] Assignee: Schorling GmbH & Co. Waggonbau, Hannover, Fed. Rep. of Germany

[21] Appl. No.: 335,137

[22] Filed: Apr. 7, 1989

[30] Foreign Application Priority Data

Apr. 8, 1988 [DE] Fed. Rep. of Germany ..... 3811716

[51] Int. Cl.[5] ..... B65F 3/20

[52] U.S. Cl. ..... 414/525.2

[58] Field of Search ..... 414/525.2, 525.3, 525.4, 414/525.5–525.6

[56] References Cited

U.S. PATENT DOCUMENTS

| | | | |
|---|---|---|---|
| 2,050,806 | 8/1936 | Rey | 414/525.2 |
| 2,263,199 | 11/1941 | Wachter et al. | 414/525.5 |
| 2,622,748 | 12/1952 | Feidert | 414/525.6 |
| 3,365,087 | 1/1968 | Roedel et al. | 414/525.5 X |
| 3,508,673 | 4/1970 | Pappas | 414/525.6 X |
| 3,688,928 | 9/1972 | Partridge | 414/525.55 |
| 4,029,224 | 6/1977 | Herpich et al. | 414/525.52 |
| 4,069,929 | 1/1978 | Harker | 414/525.5 X |
| 4,096,959 | 6/1978 | Schäffler | 414/525.5 X |

FOREIGN PATENT DOCUMENTS

| | | | |
|---|---|---|---|
| 649350 | 8/1937 | Fed. Rep. of Germany | 414/525.3 |
| 3420058 | 12/1985 | Fed. Rep. of Germany . | |
| 3401069 | 8/1986 | Fed. Rep. of Germany . | |

*Primary Examiner*—David A. Bucci

*Attorney, Agent, or Firm*—Collard, Roe & Galgano

[57] ABSTRACT

A rubbish collection vehicle with a rubbish collection container located on a chassis behind the driver's cab has a rubbish intake unit which comprises a rubbish compaction unit for forcing the rubbish in an operating direction through a container intake opening. The operating direction of the rubbish compaction unit extends at an oblique angle from the front/bottom to the top/-back upwardly to the roof of the rubbish collection container. A projection has been provided in the area of the container intake opening on the bed of the rubbish collection container to reduce the cross section of the container intake opening. As a result of the direction of operation selected, rubbish is compacted across the total cross-sectional area of the rubbish collection container, as well as being initially compacted against the roof of the rubbish collection container, thereby enabling optimal utilization of the entire container capacity. The projection on the bed of the rubbish collection container further prevents the undesirable escape of rubbish out through the container intake opening.

4 Claims, 3 Drawing Sheets

RUBBISH COLLECTION VEHICLE

BACKGROUND OF THE INVENTION

1. Field of the Invention

This invention relates to a rubbish collection vehicle of the type utilizing a compaction unit which allows the entire rubbish collection container to be used to its maximum capacity. More particularly, the invention relates to a compaction unit which pushes the rubbish upwardly from the front of the rubbish collection container to the rear thereof at an oblique angle.

2. Description of the Prior Art

German Patent DE-PS 34 01 069 discloses a rubbish collection vehicle in which rubbish is fed into a rubbish hopper from a compacting area located beneath the hopper and is forced into the rubbish collection container of the rubbish collection vehicle in a horizontal direction by a rubbish compacting plate. Due to the position of the inlet hopper above the rubbish compacting plate, which operates in the horizontal direction of operation, rubbish can be transported forwardly into the lower part (approximately $\frac{1}{3}$) of the rubbish collection container. As a consequence, rubbish compaction fails to occur in the upper part (approximately $\frac{2}{3}$) of the rubbish collection container. No rubbish whatsoever can be loaded into the front, upper space of the rubbish collection container. In the rubbish collection vehicle taught in this patent, therefore, a large part of the total available volume of the rubbish collection container cannot be effectively utilized. To counter this drawback, an extremely large rubbish collection container would have to be provided for the rubbish collection vehicle. The required large rubbish collection container would not possess satisfactory space utilization characteristics and would require a larger rubbish collection vehicle.

German Patent DE-PS 34 20 058 discloses a rubbish collection vehicle which also has a rubbish compacting plate located in the vehicle's bottom third portion, which operates to advance or push the rubbish in a horizontal direction. With the aid of a thrust plate connected to the rubbish compacting plate, the rubbish can also be pushed further into the rubbish collection container. Experience has shown that satisfactory compaction of rubbish is not achieved with this rubbish collection vehicle. Consequently, the available capacity of the rubbish collection container cannot be fully utilized.

SUMMARY OF THE INVENTION

It is an object of the invention to provide a rubbish collection vehicle which allows for front or side loading such that a higher level of uniform rubbish compaction extending over the entire rubbish collection container can be achieved, thereby allowing for an increased quantity of rubbish to be taken in.

It is a further object of the invention to provide a rubbish collection vehicle having a rubbish compaction system which maximizes the utilization of the rubbish collection container.

It is yet an additional object of the invention to provide a rubbish collection vehicle having a rubbish compaction system which is simple in design, can be used on mass produced chassis, and can be used with a removable rubbish collection container.

Accordingly, these and related objects are achieved by arranging the rubbish compaction unit such that its direction of operation proceeds upwardly towards the roof at an oblique angle from the front/bottom to the top/back of the rubbish collection container. Thus, rubbish is compacted in the total cross-sectional area of the rubbish collection container, as well as being initially compacted against the roof thereof. This allows for the total utilization of the rubbish collection container. At the same time, the rubbish compacting plate of the rubbish compaction unit, within its scope of operation, can be used only sparingly and can still achieve a correspondingly high level of compaction.

In addition, the intended direction of operation of the rubbish compaction unit makes it possible to provide for an extension on the front side of the rubbish collection container which extends in the operating direction and which, prior to detaching the container from the rubbish compaction unit, seals the container intake opening. The projection is located in the forward area of the container intake opening on the floor or bed of the rubbish collection container. The projection reduces the size of the intake opening and is considered to be a further important feature of the invention. In addition to the direction of operation of the rubbish compaction unit, the projection, which has a nose-shaped configuration which specifically prevents rubbish which has already been pushed into the rubbish collection container and compacted from exiting the container through the intake opening. This unwanted exiting of rubbish through the container intake opening can occur during a subsequent intake operation, in the event the intake remains open for a brief period of time. The projection serves as an obstacle for rubbish which has already been taken in and effectively prevents rubbish taken in from escaping back out the intake opening of the container.

In addition, the rubbish collection vehicle of the present invention enables the rubbish compaction unit to be located in such a way that the intake hopper extends as far down as possible on the chassis. Furthermore, the entire rubbish intake unit can be positioned very close to the back side of the vehicle's cab without coming into contact with superstructure elements located behind the cab, such as, for example, fenders, cab anchoring, the gears of the motor, etc.

In a first embodiment of the invention, the direction of operation extends at an angle of less than 80° and greater than 20° from the horizon towards the rear. In practice, this arc has shown itself to be particularly advantageous in achieving a uniform compaction of the rubbish taken in. This results in increasing the rubbish container capacity so that a larger amount of rubbish can be fed in.

In a second advantageous embodiment of the invention, the front side of the rubbish collection container is equipped with a telescopic extension to seal the container intake opening. This provision enables the intake opening of the rubbish collection container to be sealed before the latter is detached and separated from the rubbish compaction unit in order to be emptied.

As described above, an important feature of the rubbish collection vehicle of the present invention is that the rubbish compaction unit functions in a direction of operation which extends at an oblique angle rearwardly and upwardly. On the other hand, in the prior art front loading collection vehicles, the rubbish is advanced or pushed in a horizontal direction. The method of pushing rubbish at an oblique angle and by the operation for the rubbish compaction unit is, of course, already known in the art. However, in such known configurations, the entire rubbish intake unit is located at the rear of the rubbish collection vehicle or rubbish collection container and the rubbish is, therefore, pushed upwardly and towards the front of the vehicle. Thus, the direction of operation in the present invention, therefore, extends in the opposite direction, namely, obliquely from the front/bottom to the top/back. Furthermore, with the prior art rubbish compaction units, no provision has been made for a projection, as with the present invention. Utilization of such a projection with rubbish compaction units of the kind known in the art hardly would serve any purpose and would be altogether useless, specifically because the projection would obstruct the emptying of the rubbish collection container at the rear.

These and other objects and advantages of the present invention will become apparent from the following description of the accompanying drawings, which disclose several embodiments of the invention. It is to be understood that the drawings are to be used for purposes of illustration only, and not as a definition of the invention.

BRIEF DESCRIPTION OF THE DRAWINGS

Further advantages and details can be gleaned from the drawings wherein similar reference numerals denote similar elements throughout the several views.

DESCRIPTION OF THE PREFERRED EMBODIMENTS

Figure 1:
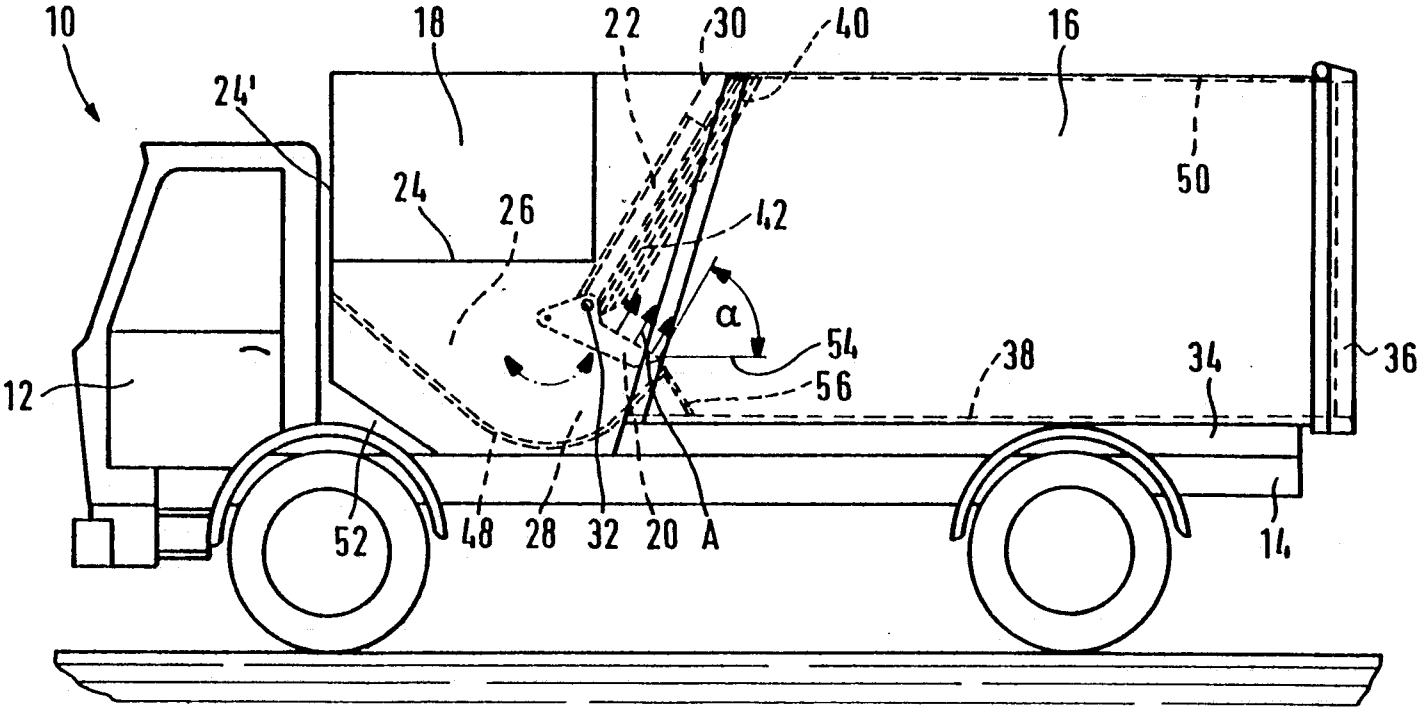
FIG. 1 is a schematic side view of a rubbish collection vehicle according to a first embodiment of the invention.

Referring to FIG. 1, there is shown a rubbish collection vehicle 10 with a driver's cab 12, chassis 14, and rubbish collection container 16 located on a support frame 34. Behind driver's cab 12, there is a rubbish intake unit 18, which is equipped with a rubbish intake opening 24 located on the side and top or with a rubbish intake opening 24' located on the top and front, behind the driver's cab. An intake hopper 26 is connected to rubbish intake openings 24 or 24', which continuously passes over the width of the container and the adjacent rubbish compaction area 28, which area is preferably cradle-shaped.

On the top and on the sides, up to the height of rubbish intake opening 24, rubbish intake unit 18 is aligned with and covered by the sides of rubbish collection container 16. Consequently, the rubbish containers may be emptied without a problem by means of a mechanism known in the art.

Figure 2:
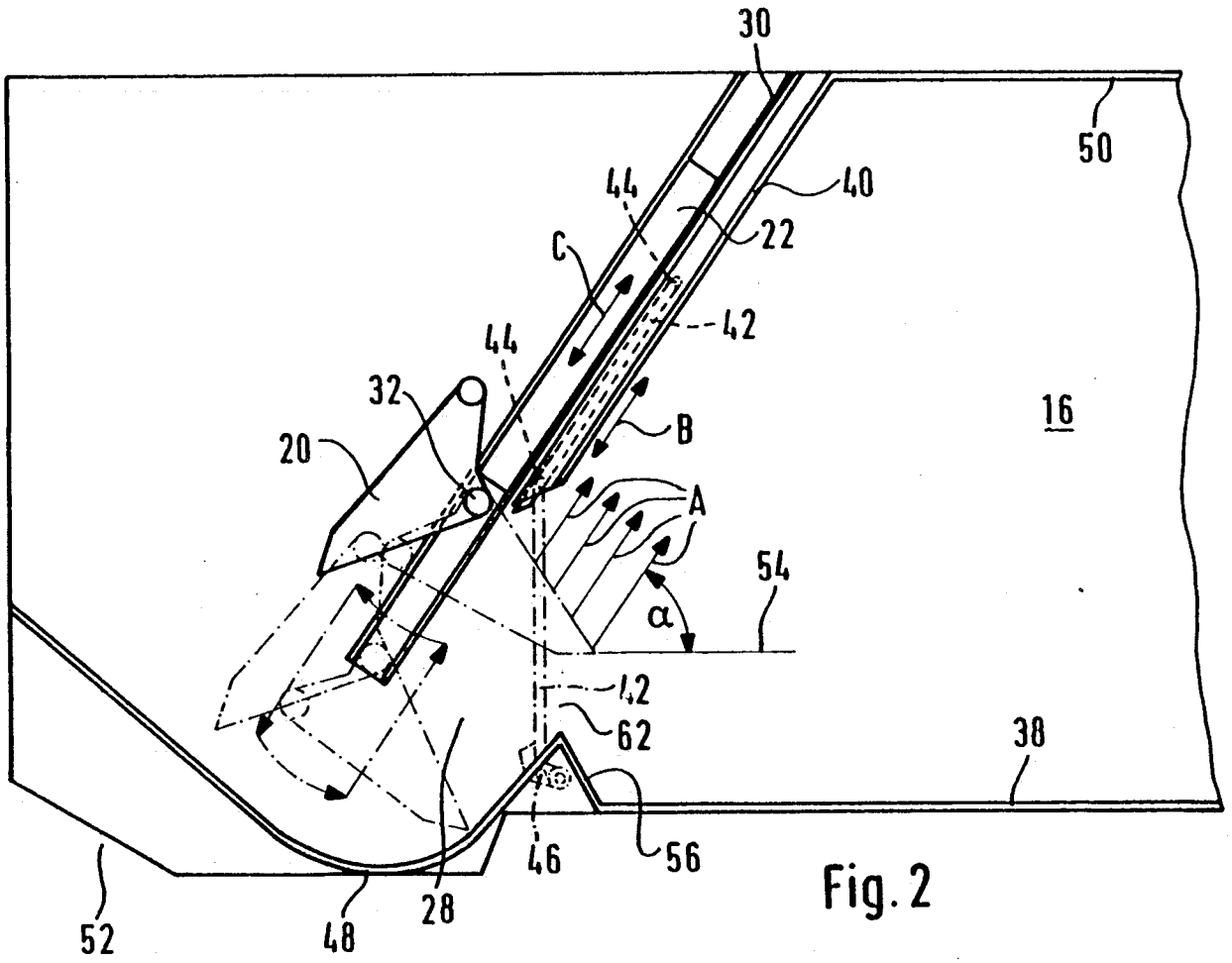
FIG. 2 is an enlarged side view of the compaction unit of the rubbish collection vehicle according to FIG. 1 in greater detail.

Rubbish intake unit 18 comprises a rubbish compacting plate 20 and a support plate 22 which supports plate 20 and which combination forms the rubbish compaction unit. The direction of operation of the rubbish compaction unit or rubbish compacting plate 20 is shown by arrows A. Rubbish is, therefore, taken into rubbish collection container 16 by rubbish compacting plate 20. Plate 20 is mounted at a pivot point 32 to the lower end of support plate 22 and which can be pivoted with the help of an operating device (not shown) such as a hydraulic cylinder. Support plate 22 is slidably mounted and can be made to slide up and down along tracks 30 in the direction of the double arrow C shown in FIG. 2. Furthermore, support plate 22 can be driven or moved along tracks 30 in an angled direction by means of an operating device (not shown).

The operating direction A of rubbish compacting plate 20 extends at an angle less than 80° and greater than 20° with respect to horizontal line 54. Rubbish collection container 16, which rests by means of support frame 34 on vehicle chassis 14, has a horizontal bed 38, a top side 50, and a front side 40. At the rear, rubbish collection container 16 is closed off by a hinged rear flap gate 36 which pivots in order to permit the emptying of the rubbish collection container.

The rubbish collection container is partially closed off in the operating direction of rubbish intake unit 18 by front side 44 to prevent the rubbish taken in from escaping from rubbish collection container 16 back into rubbish intake hopper 26 of rubbish intake unit 18. Adjacent to front side 40 of rubbish collection container 16 is a container opening 62, through which rubbish can be fed with the aid of compaction plate 20. Bed 38 of rubbish collection container 16 has a short wall extending at a forward angle in the shape of an upwardly bent elbow, thereby forming a projection 56. At its upper edge, projection 56 merges with cradle shaped bed 48 of rubbish compaction area 28. The cross section of container opening 62 is reduced by projection 56, and, moreover, projection 56 prevents rubbish which has already been taken up into the rubbish collection container from again escaping back out.

Within front side 40, there is mounted a telescopic extension 42 which, in its extended position, rotates about pivot 44 and moves into a bearing position where it can be brought to bear on projection 56. In this position, extension 42 can be locked by means of a locking device 46 in order to close off container opening 62 across its entire cross section. Thereafter, closed rubbish collection container 16 can be detached from rubbish collection vehicle 10 in order to be emptied. During this operation, rubbish intake unit 18 remains on rubbish collection vehicle 10. In effecting this detachment and separate emptying of rubbish collection container 16, extension 42 which is telescoped out in the direction of double arrow B to close off container opening 62 is of crucial importance.

It is possible to use hydraulic cylinders in actuating and operating extension 42 in conjunction with locking mechanism 46. To prevent damage where fluid cylinders are used, a sequential circuit is recommended, which circuit will ensure that extension of telescopic extension 42 will only be permitted whenever rubbish compacting plate 20 is not in the compacting position. Moreover, it is intended that the locking of extension 42 be permitted only when rotating axis 44 moves into a bearing position (in the extended position shown in FIG. 2) and extension 42 rests against locking mechanism 46.

Figure 3:
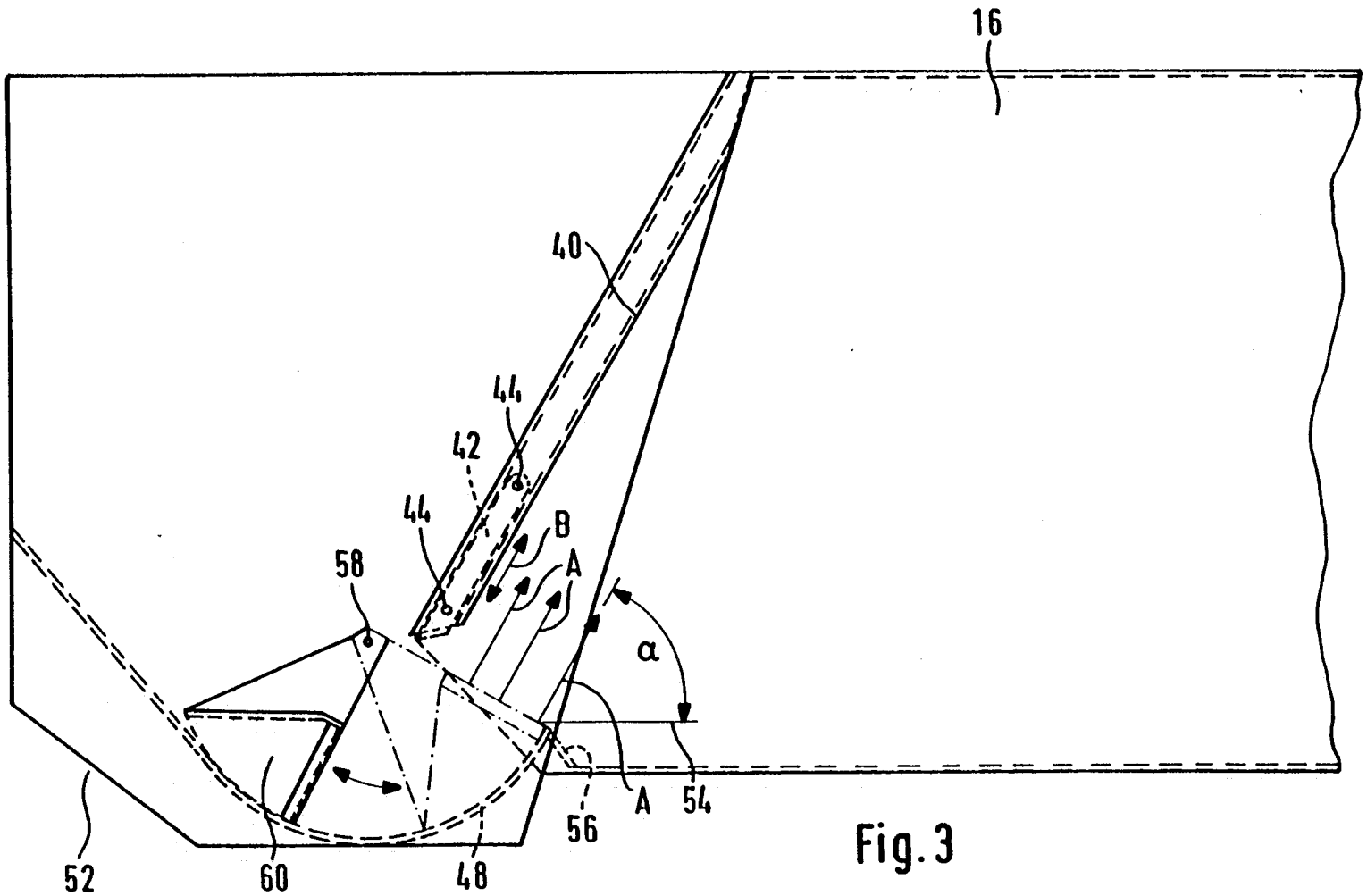
FIG. 3 is an enlarged side view of a second embodiment of the compaction unit of the rubbish collection vehicle.

Referring to FIG. 3, there is shown a second embodiment of the rubbish collection vehicle. In this configuration, a pivotable pressure plate 60 has been provided which pivots about a pivot point 58. Plate 60 pivots over cradle bed 48 into the compacting position. Thus, the direction of operation A, where angle is less than 80° and greater than 20° with respect to horizon 54, is again achieved. The difference between this embodiment and the embodiment of FIG. 2 rests in the fact that pressure plate 60 is mounted such that it can only pivot (i.e., the pivot point does not move forwardly or rearwardly with respect to the vehicle) with the result that in this configuration, support plate 22 and tracks 30 are not required.

Due to the direction "A" selected for the operation of rubbish intake unit 18 or for the operation of support plate 22 and the resulting configuration of cradle 48, intake hopper 26 can be advantageously configured in the front, lower area 52 in such a way that any existing structures above the frame do not have to be modified. As a consequence, mass produced vehicle chassis can be used in manufacturing the rubbish collection vehicle of the present invention.

While several of the embodiments and examples of the present invention have been illustrated and described, it is obvious that many changes and modifications may be made thereunto, without departing from the spirit and scope of the invention.

What is claimed is:

1. A rubbish collection vehicle comprising:

a chassis;

a driver's cabin mounted on a forward portion of said chassis;

a rubbish collection container having a floor and mounted on said chassis, rearward of said driver's cabin, on a rear portion of said chassis and having an intake opening on a front side thereof;

a rubbish intake unit mounted adjacent said driver's cabin on a forward portion of said chassis;

a rubbish compaction unit having a bottom, a front, a top and a rear end and operating to compact rubbish from said rubbish intake unit and to feed the rubbish into said rubbish collection container, said rubbish compaction unit feeding the rubbish in an operating direction extending upwardly from the bottom and front of the rubbish collecting container to a top and rear thereof at an oblique angle;

a projection extending upwardly from the floor of said rubbish collection container adjacent said intake opening so as to reduce the size of said intake opening;

wherein said front side of the rubbish collection container extends at an oblique angle above said intake opening in a direction parallel to said operating direction;

wherein said front side of said rubbish collection container is equipped with a telescopically extendable plate to seal said rubbish collection container intake opening; and wherein the telescopically extendable plate pivots in its fully extended position about a pivot point and, for the purpose of closing said intake opening, abuts said projection on the floor of said rubbish collection container.

2. The rubbish collection vehicle as set forth in claim 1, wherein the rubbish compaction unit is located on said oblique front side of said rubbish collection container.

3. The rubbish collection vehicle as set forth in claim 1, wherein said bottom of said rubbish compaction unit is horizontal; and wherein said operating direction extends upwardly and rearwardly at an oblique angle of less than 80° and greater than 20° from the horizontal.

4. The rubbish collection vehicle as set forth in claim 1, wherein said rubbish compaction unit comprises a support plate mounted on said front side of said rubbish collection container which plate is extendable in the direction of operation and which plate, at its lower end, supports a rubbish compaction plate.

* * * * *